US008081762B2

(12) United States Patent
Ojala et al.

(10) Patent No.: US 8,081,762 B2
(45) Date of Patent: Dec. 20, 2011

(54) CONTROLLING THE DECODING OF BINAURAL AUDIO SIGNALS

(75) Inventors: Pasi Sakari Ojala, Kirkkonummi (FI); Julia Turku, Espoo (FI)

(73) Assignee: Nokia Corporation, Espoo (FI)

( * ) Notice: Subject to any disclaimer, the term of this patent is extended or adjusted under 35 U.S.C. 154(b) by 101 days.

(21) Appl. No.: 12/087,206

(22) PCT Filed: Jan. 9, 2006

(86) PCT No.: PCT/FI2006/050015

§ 371 (c)(1),
(2), (4) Date: Oct. 8, 2008

(87) PCT Pub. No.: WO2007/080212

PCT Pub. Date: Jul. 19, 2007

(65) Prior Publication Data

US 2009/0129601 A1 May 21, 2009

(51) Int. Cl.
*H04R 5/00* (2006.01)

(52) U.S. Cl. ..... 381/1; 381/22; 381/23; 704/500

(58) Field of Classification Search ..... 381/1, 2, 381/309–310, 17–23, 74, 27; 704/500–504
See application file for complete search history.

(56) References Cited

U.S. PATENT DOCUMENTS

| | | | | |
|---|---|---|---|---|
| 6,307,941 | B1 | 10/2001 | Tanner, Jr. et al. | |
| 7,167,567 | B1 * | 1/2007 | Sibbald et al. | 381/17 |
| 2003/0219130 | A1 * | 11/2003 | Baumgarte et al. | 381/17 |
| 2003/0235317 | A1 | 12/2003 | Baumgarte | |
| 2005/0058304 | A1 * | 3/2005 | Baumgarte et al. | 381/98 |
| 2005/0180579 | A1 * | 8/2005 | Baumgarte et al. | 381/63 |
| 2006/0206323 | A1 * | 9/2006 | Breebaart | 704/230 |

FOREIGN PATENT DOCUMENTS

| | | |
|---|---|---|
| EP | 1182643 | 2/2002 |
| EP | 1565036 | 8/2005 |
| WO | 9931938 | 6/1999 |

OTHER PUBLICATIONS

Frank Baumgarte and Christof Faller, Binaural Cue Coding—Part II: Schemes and Applications, IEEE Transactions on Speech and Audio Processing, vol. 11, No. 6, Nov. 2003.*

Frank Baumgarte and Christof Faller, Why Binaural Cue Coding is better than Intensity Stereo Coding, Audio Engineering Society, Conventon Paper 5575, Presented at the 112th Convention, May 10-13, 2002, Munich, Germany.*

May 28, 2005, Herre et al., "The Reference Model Architecture for MPEG Spatial Audio Coding", Audio Engineering Society, Convention Paper 6447, presented May 28, 2005.

Apr. 14, 2010, Office Action with translation dated Apr. 14, 2010 from Korean Application No. 10-2008-7017490, 10 pages.

Apr. 22, 2011, Translated Office Action dated Apr. 22, 2011 from Japanese Application No. 2008-549029, 6 pages.

* cited by examiner

*Primary Examiner* — Vivian Chin
*Assistant Examiner* — Friedrich Fahnert
(74) *Attorney, Agent, or Firm* — Hollingsworth & Funk, LLC

(57) ABSTRACT

A method for generating a parametrically encoded audio signal, the method comprising: inputting a multi-channel audio signal comprising a plurality of audio channels; generating at least one combined signal of the plurality of audio channels; and generating one or more corresponding sets of side information including channel configuration information for controlling audio source locations in a synthesis of a binaural audio signal.

29 Claims, 3 Drawing Sheets

CONTROLLING THE DECODING OF BINAURAL AUDIO SIGNALS

FIELD OF THE INVENTION

The present invention relates to spatial audio coding, and more particularly to controlling the decoding of binaural audio signals.

BACKGROUND OF THE INVENTION

In spatial audio coding, a two/multi-channel audio signal is processed such that the audio signals to be reproduced on different audio channels differ from one another, thereby providing the listeners with an impression of a spatial effect around the audio source. The spatial effect can be created by recording the audio directly into suitable formats for multi-channel or binaural reproduction, or the spatial effect can be created artificially in any two/multi-channel audio signal, which is known as spatialization.

It is generally known that for headphones reproduction artificial spatialization can be performed by HRTF (Head Related Transfer Function) filtering, which produces binaural signals for the listener's left and right ear. Sound source signals are filtered with filters derived from the HRTFs corresponding to their direction of origin. A HRTF is the transfer function measured from a sound source in free field to the ear of a human or an artificial head, divided by the transfer function to a microphone replacing the head and placed in the middle of the head. Artificial room effect (e.g. early reflections and/or late reverberation) can be added to the spatialized signals to improve source externalization and naturalness.

As the variety of audio listening and interaction devices increases, compatibility becomes more important. Amongst spatial audio formats the compatibility is striven through upmix and downmix techniques. It is generally known that there are algorithms for converting multi-channel audio signal into stereo format, such as Dolby Digital® and Dolby Surround®, and for further converting stereo signal into binaural signal. However, in this kind of processing the spatial image of the original multi-channel audio signal cannot be fully reproduced. A better way of converting multi-channel audio signal for headphone listening is to replace the original loudspeakers with virtual loudspeakers by employing HRTF filtering and to play the loudspeaker channel signals through those (e.g. Dolby Headphone®). However, this process has the disadvantage that, for generating a binaural signal, a multi-channel mix is always first needed. That is, the multi-channel (e.g. 5+1 channels) signals are first decoded and synthesized, and HRTFs are then applied to each signal for forming a binaural signal. This is computationally a heavy approach compared to decoding directly from the compressed multi-channel format into binaural format.

Binaural Cue Coding (BCC) is a highly developed parametric spatial audio coding method. BCC represents a spatial multi-channel signal as a single (or several) downmixed audio channel and a set of perceptually relevant inter-channel differences estimated as a function of frequency and time from the original signal. The method allows for a spatial audio signal mixed for an arbitrary loudspeaker layout to be converted for any other loudspeaker layout, consisting of either same or different number of loudspeakers.

Accordingly, the BCC is designed for multi-channel loudspeaker systems. The original loudspeaker layout determines the content of the encoder output, i.e. the BCC processed mono signal and its side information, and the loudspeaker layout of the decoder unit determines how this information is converted for reproduction. When reproduced for spatial headphones playback, the original loudspeaker layout dictates the sound source locations of the binaural signal to be generated. Thus, even though a spatial binaural signal, as such, would allow for a flexible alternation of sound source locations, the loudspeaker layout of a binaural signal generated from the conventionally encoded BCC signal is fixed to the sound source locations of the original multi-channel signal. This limits the application of enhanced spatial effects.

SUMMARY OF THE INVENTION

Now there is invented an improved method and technical equipment implementing the method, by which the content creator is able to control the binaural downmix process in the decoder. Various aspects of the invention include an encoding method, an encoder, a decoding method, a decoder, an apparatus, and computer programs, which are characterized by what is stated in the independent claims. Various embodiments of the invention are disclosed in the dependent claims.

According to a first aspect, a method according to the invention is based on the idea of generating a parametrically encoded audio signal, the method comprising: inputting a multi-channel audio signal comprising a plurality of audio channels; generating at least one combined signal of the plurality of audio channels; and generating one or more corresponding sets of side information including channel configuration information for controlling audio source locations in a synthesis of a binaural audio signal. Thus, the idea is to include channel configuration information, i.e. audio source location information, which can be either static or variable, into the side information to be used in the decoding. The channel configuration information enables the content creator to control the movements of the locations of the sound sources in the spatial audio image perceived by a headphones listener.

According to an embodiment, said audio source locations are static throughout a binaural audio signal sequence, whereby the method further comprises: including said channel configuration information as an information field in said one or more corresponding sets of side information corresponding to said binaural audio signal sequence.

According to an embodiment, said audio source locations are variable, whereby the method further comprises: including said channel configuration information in said one or more corresponding sets of side information as a plurality of information fields reflecting variations in said audio source locations.

According to an embodiment, said set of side information further comprises the number and locations of loudspeakers of an original multi-channel sound image in relation to a listening position, and an employed frame length.

According to an embodiment, said set of side information further comprises inter-channel cues used in Binaural Cue Coding (BCC) scheme, such as Inter-channel Time Difference (ICTD), Inter-channel Level Difference (ICLD) and Inter-channel Coherence (ICC).

According to an embodiment, said set of side information further comprises a set of gain estimates for the channel signals of the multi-channel audio describing the original sound image.

A second aspect provides a method for synthesizing a binaural audio signal, the method comprising: inputting a parametrically encoded audio signal comprising at least one combined signal of a plurality of audio channels and one or more corresponding sets of side information describing a multi-channel sound image and including channel configuration information; processing the at least one combined signal according to said corresponding set of side information; and synthesizing a binaural audio signal from the at least one processed signal, wherein said channel configuration information is used for controlling audio source locations in the binaural audio signal.

According to an embodiment, said set of side information further comprises inter-channel cues used in Binaural Cue Coding (BCC) scheme, such as Inter-channel Time Difference (ICTD), Inter-channel Level Difference (ICLD) and Inter-channel Coherence (ICC).

According to an embodiment, the step of processing the at least one combined signal further comprises: synthesizing the original audio signals of the plurality of audio channels from the at least one combined signal in a Binaural Cue Coding (BCC) synthesis process, which is controlled according to said one or more corresponding sets of side information; and applying the plurality of the synthesized audio signals to a binaural downmix process.

According to an embodiment, said set of side information further comprises a set of gain estimates for the channel signals of the multi-channel audio describing the original sound image.

According to an embodiment, the step of processing the at least one combined signal further comprises: applying a predetermined set of head-related transfer function filters to the at least one combined signal in proportion determined by said corresponding set of side information to synthesize a binaural audio signal.

The arrangement according to the invention provides significant advantages. A major advantage is that the content creator is able to control the binaural downmix process in the decoder, i.e. the content creator has more flexibility to design a dynamic audio image for the binaural content than for loudspeaker representation with physically fixed loudspeaker positions. The spatial effect could be enhanced e.g. by moving the sound sources, i.e. virtual speakers further apart from the centre (median) axis. A further advantage is that one or more sound sources could be moved during the playback, thus enabling special audio effects.

The further aspects of the invention include various apparatuses arranged to carry out the inventive steps of the above methods.

LIST OF DRAWINGS

In the following, various embodiments of the invention will be described in more detail with reference to the appended drawings, in which FIG. 1 shows a generic Binaural Cue Coding (BCC) scheme according to prior art;

Figure 4A:
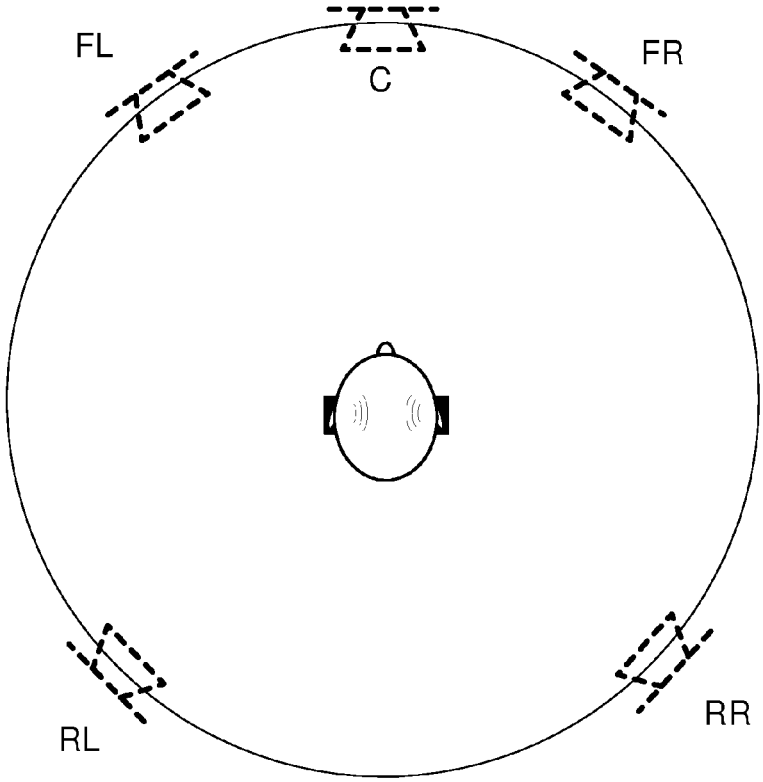
Figure 4B:
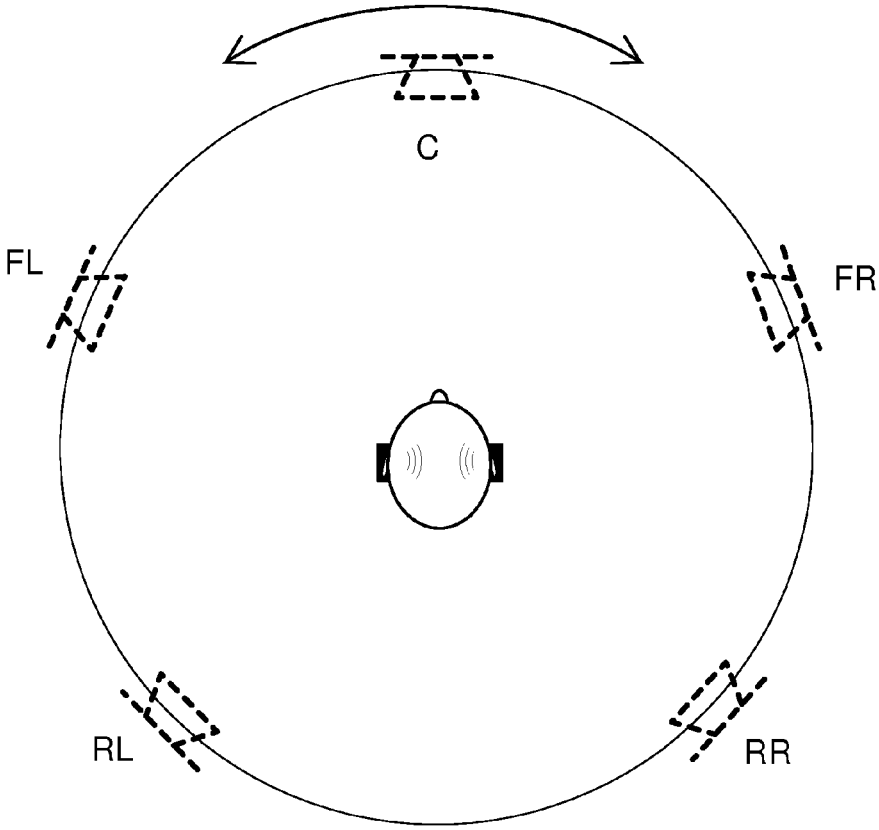
Figure 5:
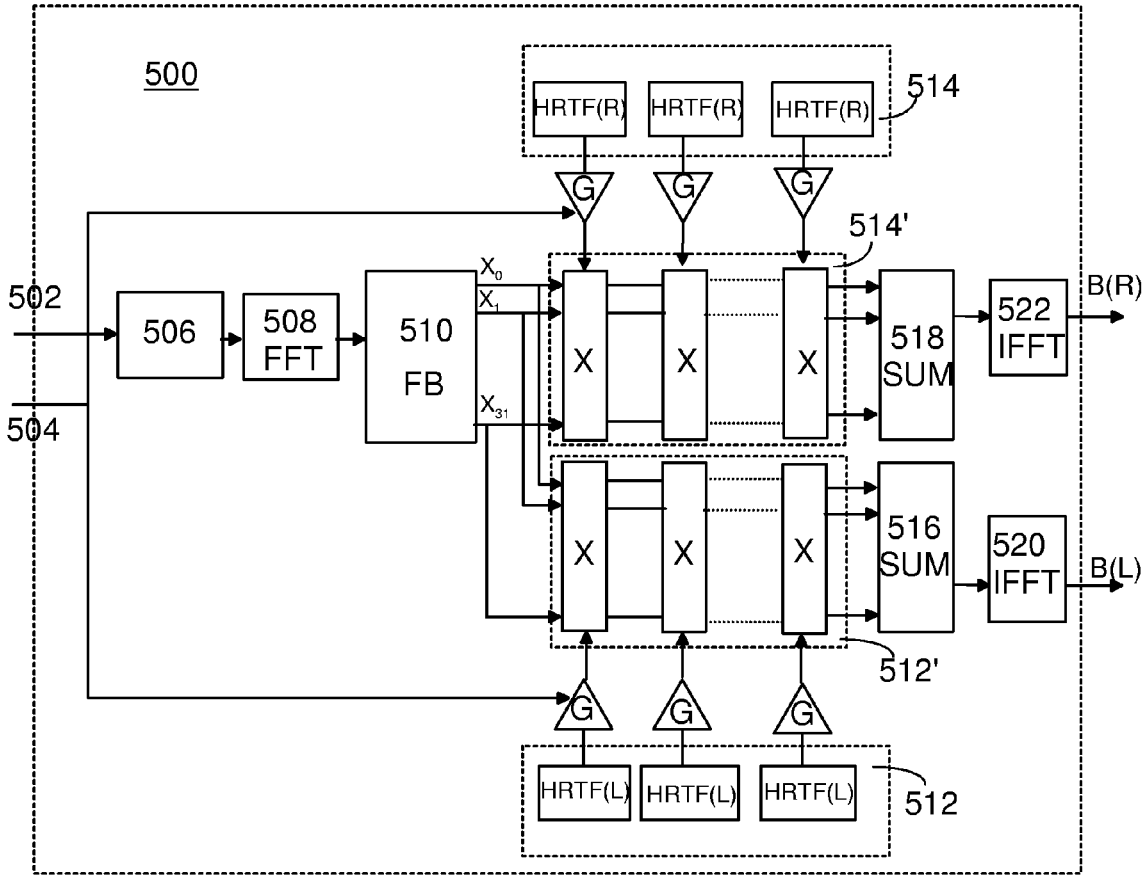
Figure 6:
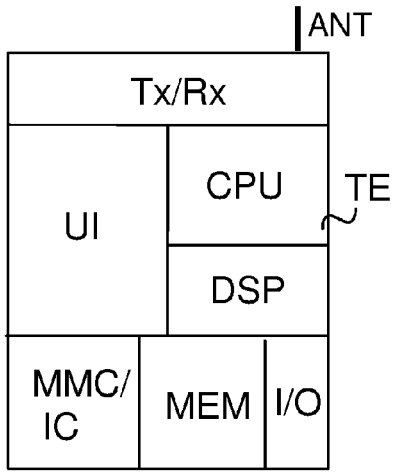

FIGS. 4*a*, 4*b* show alternations of the locations of the sound sources in the spatial audio image according to an embodiment of the invention;

FIG. 5 shows a block diagram of the binaural decoder according to an embodiment of the invention; and FIG. 6 shows an electronic device according to an embodiment of the invention in a reduced block chart.

DESCRIPTION OF EMBODIMENTS

In the following, the invention will be illustrated by referring to Binaural Cue Coding (BCC) as an exemplified platform for implementing the encoding and decoding schemes according to the embodiments. It is, however, noted that the invention is not limited to BCC-type spatial audio coding methods solely, but it can be implemented in any audio coding scheme providing at least one audio signal combined from the original set of one or more audio channels and appropriate spatial side information.

Figure 1:
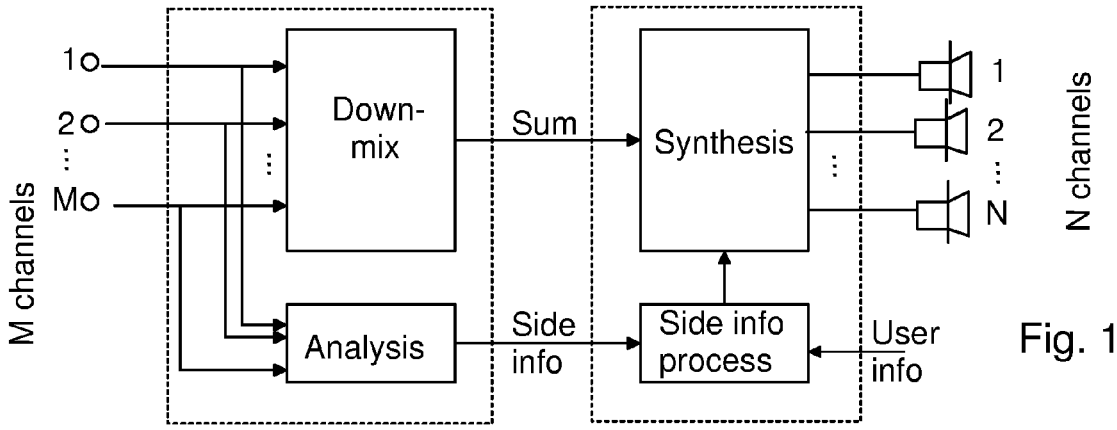

Binaural Cue Coding (BCC) is a general concept for parametric representation of spatial audio, delivering multi-channel output with an arbitrary number of channels from a single audio channel plus some side information. FIG. 1 illustrates this concept. Several (M) input audio channels are combined into a single output (S; "sum") signal by a downmix process. In parallel, the most salient inter-channel cues describing the multi-channel sound image are extracted from the input channels and coded compactly as BCC side information. Both sum signal and side information are then transmitted to the receiver side, possibly using an appropriate low bitrate audio coding scheme for coding the sum signal. On the receiver side, the BCC decoder knows the number (N) of the loudspeakers as user input. Finally, the BCC decoder generates a multi-channel (N) output signal for loudspeakers from the transmitted sum signal and the spatial cue information by re-synthesizing channel output signals, which carry the relevant inter-channel cues, such as Inter-channel Time Difference (ICTD), Inter-channel Level Difference (ICLD) and Inter-channel Coherence (ICC). Accordingly, the BCC side information, i.e. the inter-channel cues, is chosen in view of optimising the reconstruction of the multi-channel audio signal particularly for loudspeaker playback.

There are two BCC schemes, namely BCC for Flexible Rendering (type I BCC), which is meant for transmission of a number of separate source signals for the purpose of rendering at the receiver, and BCC for Natural Rendering (type II BCC), which is meant for transmission of a number of audio channels of a stereo or surround signal. BCC for Flexible Rendering takes separate audio source signals (e.g. speech signals, separately recorded instruments, multitrack recording) as input. BCC for Natural Rendering, in turn, takes a "final mix" stereo or multi-channel signal as input (e.g. CD audio, DVD surround). If these processes are carried out through conventional coding techniques, the bitrate scales proportionally or at least nearly proportionally to the number of audio channels, e.g. transmitting the six audio channels of the 5.1. multi-channel system requires a bitrate nearly six times of one audio channel. However, both BCC schemes result in a bitrate, which is only slightly higher than the bitrate required for the transmission of one audio channel, since the BCC side information requires only a very low bitrate (e.g. 2 kb/s).

Figure 2:
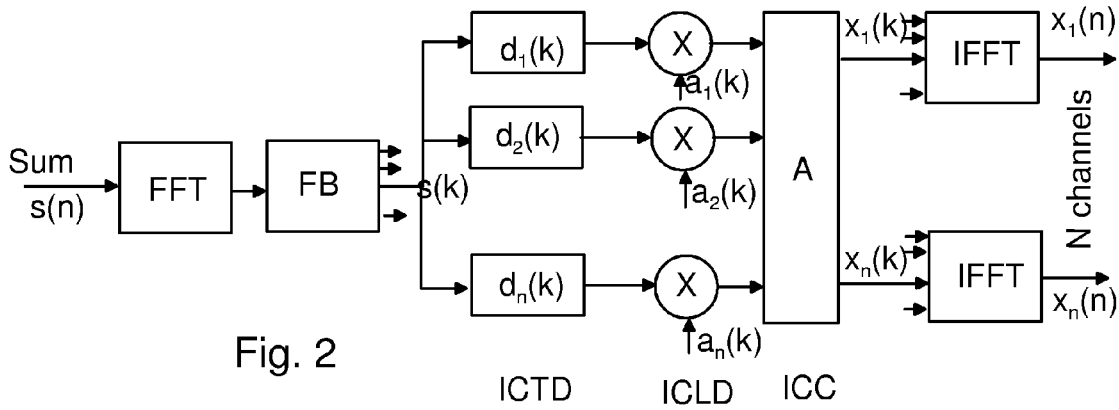
FIG. 2 shows the general structure of a BCC synthesis scheme according to prior art.

FIG. 2 shows the general structure of a BCC synthesis scheme. The transmitted mono signal ("sum") is first windowed in time domain into frames and then mapped to a spectral representation of appropriate subbands by a FFT process (Fast Fourier Transform) and a filterbank FB. In the general case of playback channels the ICLD and ICTD are considered in each subband between pairs of channels, i.e. for each channel relative to a reference channel. The subbands are selected such that a sufficiently high frequency resolution is achieved, e.g. a subband width equal to twice the ERB scale (Equivalent Rectangular Bandwidth) is typically considered suitable. For each output channel to be generated, individual time delays ICTD and level differences ICLD are imposed on the spectral coefficients, followed by a coherence synthesis process which re-introduces the most relevant aspects of coherence and/or correlation (ICC) between the synthesized audio channels. Finally, all synthesized output channels are converted back into a time domain representation by an IFFT process (Inverse FFT), resulting in the multi-channel output. For a more detailed description of the BCC approach, a reference is made to: F. Baumgarte and C. Faller: "*Binaural Cue Coding—Part I: Psychoacoustic Fundamentals and Design Principles*"; IEEE Transactions on Speech and Audio Processing, Vol. 11, No. 6, November 2003, and to: C. Faller and F. Baumgarte: "*Binaural Cue Coding—Part II: Schemes and Applications*", IEEE Transactions on Speech and Audio Processing, Vol. 11, No. 6, November 2003.

Figure 3:
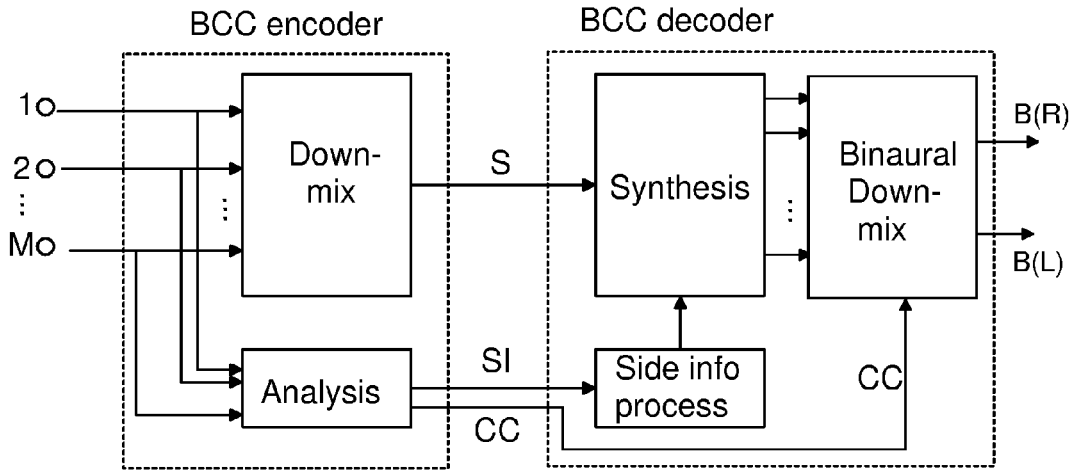
FIG. 3 shows a generic binaural coding scheme according to an embodiment of the invention.

The BCC is an example of coding schemes, which provide a suitable platform for implementing the encoding and decoding schemes according to the embodiments. The basic principle underlying the embodiments is illustrated in FIG. 3. The encoder according to an embodiment combines a plurality of input audio channels (M) into one or more combined signals (S) and concurrently encodes the multi-channel sound image as BCC side information (SI). Furthermore, the encoder creates channel configuration information (CC), i.e. audio source location information, which can be static throughout the audio presentation, whereby only a single information block is required in the beginning of the audio stream as header information. Alternatively, the audio scene may be dynamic, whereby location updates are included in the transmitted bit stream. The source location updates are variable rate by nature. Hence, utilising arithmetic coding, the information can be coded efficiently for the transport. The channel configuration information (CC) is preferably coded within the side information (SI).

The one or more sum signals (S), the side information (SI) and the channel configuration information (CC) are then transmitted to the receiver side, wherein the sum signal (S) is fed into the BCC synthesis process, which is controlled according to the inter-channel cues derived through the processing of the side information. The output of the BCC synthesis process is fed into binaural downmix process, which, in turn, is controlled by the channel configuration information (CC). In the binaural downmix process, the used pairs of HRTFs are altered according to channel configuration information (CC), which alternations move the locations of the sound sources in the spatial audio image sensed by a headphones listener.

The alternations of the locations of the sound sources in the spatial audio image are illustrated in FIGS. 4*a* and 4*b*. In FIG. 4*a*, a spatial audio image is created for a headphones listener as a binaural audio signal, in which phantom loudspeaker positions (i.e. sound sources) are created in accordance with conventional 5.1 loudspeaker configuration. Loudspeakers in the front of the listener (FL and FR) are placed 30 degrees from the centre speaker (C). The rear speakers (RL and RR) are placed 110 degrees calculated from the centre. Due to the binaural effect, the sound sources appear to be in binaural playback with headphones in the same locations as in actual 5.1 playback.

In FIG. 4*b*, the spatial audio image is altered through rendering the audio image in binaural domain such that the front sound sources FL and FR (phantom loudspeakers) are moved further apart to create enhanced spatial image. The movement is accomplished by selecting a different HRTF pair for FL and FR channel signals according to the channel configuration information. Alternatively, any or all of the sound sources can be moved in different position, even during the playback. Hence, the content creator has more flexibility to design a dynamic audio image when rendering the binaural audio content.

In order to allow for smooth movements of sound sources, the decoder must contain a sufficient number of HRTF pairs to freely alter the locations of the sound sources in the spatial audio image. It can be assumed that a human auditory system cannot distinguish two locations of sound sources, which are closer than two to five degrees to each other, depending on the angle of incidence. However, exploiting the smoothness of variation of the HRTF as a function of the angle of incidence through interpolation, a sufficient resolution can be achieved with a sparser set of HRTF filters. If the whole spatial audio image of 360 degrees needs to be covered, the sufficient number of HRTF pairs is 360/10=36 HRTF pairs. Of course, most of the spatial effects do not require continuously varying change of the sound source location, whereby even less than 36 pairs of HRTFs may naturally be used, but then a listener typically senses the change of the sound source location distinctive.

The channel configuration information according to the invention and its effects in spatial audio image can be applied in the conventional BCC coding scheme, wherein the channel configuration information is coded within the side information (SI) carrying the relevant spatial inter-channel cues ICTD, ICLD and ICC. The BCC decoder synthesizes the original audio image for a plurality of loudspeakers on the basis of the received sum signal (S) and the side information (SI), and the plurality of output signals from the synthesis process are further applied to a binaural downmix process, wherein the selecting of HRTF pairs is controlled according to the channel configuration information.

However, generating a binaural signal from a BCC processed mono signal and its side information thus requires that a multi-channel representation is first synthesised on the basis of the mono signal and the side information, and only then it may be possible to generate a binaural signal for spatial headphones playback from the multi-channel representation. This is computationally a heavy approach, which is not optimised in view of generating a binaural signal.

Therefore, the BCC decoding process can be simplified in view of generating a binaural signal according to an embodiment, wherein, instead of synthesizing the multi-channel representation, each loudspeaker in the original mix is replaced with a pair of HRTFs corresponding to the direction of the loudspeaker in relation to the listening position. Each frequency channel of the monophonized signal is fed to each pair of filters implementing the HRTFs in the proportion dictated by a set of gain values having the channel configuration information coded therein. Consequently, the process can be thought of as implementing a set of virtual loudspeakers, corresponding to the original ones, in the binaural audio scene. Accordingly, the embodiment allows for a binaural audio signal to be derived directly from parametrically encoded spatial audio signal without any intermediate BCC synthesis process.

This embodiment is further illustrated in the following with reference to FIG. 5, which shows a block diagram of the binaural decoder according to the embodiment. The decoder 500 comprises a first input 502 for the monophonized signal and a second input 504 for the side information including the channel configuration information coded therein. The inputs 502, 504 are shown as distinctive inputs for the sake of illustrating the embodiments, but a skilled man appreciates that in practical implementation, the monophonized signal and the side information can be supplied via the same input.

According to an embodiment, the side information does not have to include the same inter-channel cues as in the BCC schemes, i.e. Inter-channel Time Difference (ICTD), Inter-channel Level Difference (ICLD) and Inter-channel Coherence (ICC), but instead only a set of gain estimates defining the distribution of sound pressure among the channels of the original mix at each frequency band suffice. The channel configuration information may be coded within the gain estimates, or it can be transmitted as a single information block, such as header information, in the beginning of the audio stream or in a separate field included occasionally in the transmitted bit stream. In addition to the gain estimates and the channel configuration information, the side information preferably includes the number and locations of the loudspeakers of the original mix in relation to the listening position, as well as the employed frame length. According to an embodiment, instead of transmitting the gain estimates as a part of the side information from an encoder, the gain estimates are computed in the decoder from the inter-channel cues of the BCC schemes, e.g. from ICLD.

The decoder 500 further comprises a windowing unit 506 wherein the monophonized signal is first divided into time frames of the employed frame length, and then the frames are appropriately windowed, e.g. sine-windowed. An appropriate frame length should be adjusted such that the frames are long enough for discrete Fourier-transform (DFT) while simultaneously being short enough to manage rapid variations in the signal. Experiments have shown that a suitable frame length is around 50 ms. Accordingly, if the sampling frequency of 44.1 kHz (commonly used in various audio coding schemes) is used, then the frame may comprise, for example, 2048 samples which results in the frame length of 46.4 ms. The windowing is preferably done such that adjacent windows are overlapping by 50% in order to smoothen the transitions caused by spectral modifications (level and delay).

Thereafter, the windowed monophonized signal is transformed into frequency domain in a FFT unit 508. The processing is done in the frequency domain in the objective of efficient computation. For this purpose, the signal is fed into a filter bank 510, which divides the signal into psycho-acoustically motivated frequency bands. According to an embodiment, the filter bank 510 is designed such that it is arranged to divide the signal into 32 frequency bands complying with the commonly acknowledged Equivalent Rectangular Bandwidth (ERB) scale, resulting in signal components $x_0, \ldots, x_{31}$ on said 32 frequency bands.

The decoder 500 comprises a set of HRTFs 512, 514 as pre-stored information, from which a left-right pair of HRTFs corresponding to each loudspeaker direction is chosen according to the channel configuration information. For the sake of illustration, two sets of HRTFs 512, 514 is shown in FIG. 5, one for the left-side signal and one for the right-side signal, but it is apparent that in practical implementation one set of HRTFs will suffice. For adjusting the chosen left-right pairs of HRTFs to correspond to each loudspeaker channel sound level, the gain values G are preferably estimated. As mentioned above, the gain estimates may be included in the side information received from the encoder, or they may be calculated in the decoder on the basis of the BCC side information. Accordingly, a gain is estimated for each loudspeaker channel as a function of time and frequency, and in order to preserve the gain level of the original mix, the gains for each loudspeaker channel are preferably adjusted such that the sum of the squares of each gain value equals to one. This provides the advantage that, if N is the number of the channels to be virtually generated, then only N−1 gain estimates needs to be transmitted from the encoder, and the missing gain value can be calculated on the basis of the N−1 gain values. A skilled man, however, appreciates that the operation of the invention does not necessitate adjusting the sum of the squares of each gain value to be equal to one, but the decoder can scale the squares of the gain values such that the sum equals to one.

Accordingly, suitable left-right pairs of the HRTF filters 512, 514 are selected according to the channel configuration information, and the selected HRTF pairs are then adjusted in the proportion dictated by the set of gains G, resulting in adjusted HRTF filters 512', 514'. Again it is noted that in practice the original HRTF filter magnitudes 512, 514 are merely scaled according to the gain values, but for the sake of illustrating the embodiments, "additional" sets of HRTFs 512', 514' are shown in FIG. 5.

For each frequency band, the mono signal components $x_0, \ldots, x_{31}$ are fed to each left-right pair of the adjusted HRTF filters 512', 514'. The filter outputs for the left-side signal and for the right-side signal are then summed up in summing units 516, 518 for both binaural channels. The summed binaural signals are sine-windowed again, and transformed back into time domain by an inverse FFT process carried out in IFFT units 520, 522. In case the analysis filters don't sum up to one, or their phase response is not linear, a proper synthesis filter bank is then preferably used to avoid distortion in the final binaural signals $B_R$ and $B_L$.

According to an embodiment, in order to enhance the externalization, i.e. out-of-the-head localisation, of the binaural signal, a moderate room response can be added to the binaural signal. For that purpose, the decoder may comprise a reverberation unit, located preferably between the summing units 516, 518 and the IFFT units 520, 522. The added room response imitates the effect of the room in a loudspeaker listening situation. The reverberation time needed is, however, short enough such that computational complexity is not remarkably increased.

A skilled man appreciates that, since the HRTFs are highly individual and averaging is impossible, perfect re-spatialization could only be achieved by measuring the listener's own unique HRTF set. Accordingly, the use of HRTFs inevitably colorizes the signal such that the quality of the processed audio is not equivalent to the original. However, since measuring each listener's HRTFs is an unrealistic option, the best possible result is achieved, when either a modelled set or a set measured from a dummy head or a person with a head of average size and remarkable symmetry, is used.

As stated earlier, according to an embodiment the gain estimates may be included in the side information received from the encoder. Consequently, an aspect of the invention relates to an encoder for multichannel spatial audio signal that estimates a gain for each loudspeaker channel as a function of frequency and time and includes the gain estimations in the side information to be transmitted along the one (or more) combined channel. Furthermore, the encoder includes the channel configuration information into the side information according to the instructions of the content creator. Consequently, the content creator is able to control the binaural downmix process in the decoder. The spatial effect could be enhanced e.g. by moving the sound sources (virtual speakers) further apart from the centre (median) axis. In addition, one or more sound sources could be moved during the playback, thus enabling special audio effects. Hence, the content creator has more freedom and flexibility in designing the audio image for the binaural content than for loudspeaker representation with (physically) fixed loudspeaker positions.

The encoder may be, for example, a BCC encoder known as such, which is further arranged to calculate the gain estimates, either in addition to or instead of, the inter-channel cues ICTD, ICLD and ICC describing the multi-channel sound image. The encoder may encode the channel configuration information within the gain estimates, or as a single information block in the beginning of the audio stream, in case of static channel configuration, or if dynamic configuration update is used, in a separate field included occasionally in the transmitted bit stream. Then both the sum signal and the side information, comprising at least the gain estimates and the channel configuration information, are transmitted to the receiver side, preferably using an appropriate low bitrate audio coding scheme for coding the sum signal.

According to an embodiment, if the gain estimates are calculated in the encoder, the calculation is carried out by comparing the gain level of each individual channel to the cumulated gain level of the combined channel. I.e. if we denote the gain levels by X, the individual channels of the original loudspeaker layout by "m" and samples by "k", then for each channel the gain estimate is calculated as $|X_m(k)|/|X_{SUM}(k)|$. Accordingly, the gain estimates determine the proportional gain magnitude of each individual channel in comparison to total gain magnitude of all channels.

For the sake of simplicity, the previous examples are described such that the input channels (M) are downmixed in the encoder to form a single combined (e.g. mono) channel. However, the embodiments are equally applicable in alternative implementations, wherein the multiple input channels (M) are downmixed to form two or more separate combined channels (S), depending on the particular audio processing application. If the downmixing generates multiple combined channels, the combined channel data can be transmitted using conventional audio transmission techniques. For example, if two combined channels are generated, conventional stereo transmission techniques may be employed. In this case, a BCC decoder can extract and use the BCC codes to synthesize a binaural signal from the two combined channels.

According to an embodiment, the number (N) of the virtually generated "loudspeakers" in the synthesized binaural signal may be different than (greater than or less than) the number of input channels (M), depending on the particular application. For example, the input audio could correspond to 7.1 surround sound and the binaural output audio could be synthesized to correspond to 5.1 surround sound, or vice versa.

The above embodiments may be generalized such that the embodiments of the invention allow for converting M input audio channels into S combined audio channels and one or more corresponding sets of side information, where M>S, and for generating N output audio channels from the S combined audio channels and the corresponding sets of side information, where N>S, and N may be equal to or different from M.

Since the bitrate required for the transmission of one combined channel and the necessary side information is very low, the invention is especially well applicable in systems, wherein the available bandwidth is a scarce resource, such as in wireless communication systems. Accordingly, the embodiments are especially applicable in mobile terminals or in other portable device typically lacking high-quality loudspeakers, wherein the features of multi-channel surround sound can be introduced through headphones listening the binaural audio signal according to the embodiments. A further field of viable applications include teleconferencing services, wherein the participants of the teleconference can be easily distinguished by giving the listeners the impression that the conference call participants are at different locations in the conference room.

FIG. 6 illustrates a simplified structure of a data processing device (TE), wherein the binaural decoding system according to the invention can be implemented. The data processing device (TE) can be, for example, a mobile terminal, a PDA device or a personal computer (PC). The data processing unit (TE) comprises I/O means (I/O), a central processing unit (CPU) and memory (MEM). The memory (MEM) comprises a read-only memory ROM portion and a rewriteable portion, such as a random access memory RAM and FLASH memory. The information used to communicate with different external parties, e.g. a CD-ROM, other devices and the user, is transmitted through the I/O means (I/O) to/from the central processing unit (CPU). If the data processing device is implemented as a mobile station, it typically includes a transceiver Tx/Rx, which communicates with the wireless network, typically with a base transceiver station (BTS) through an antenna. User Interface (UI) equipment typically includes a display, a keypad, a microphone and connecting means for headphones. The data processing device may further comprise connecting means MMC, such as a standard form slot, for various hardware modules or as integrated circuits IC, which may provide various applications to be run in the data processing device.

Accordingly, the binaural decoding system according to the invention may be executed in a central processing unit CPU or in a dedicated digital signal processor DSP (a parametric code processor) of the data processing device, whereby the data processing device receives a parametrically encoded audio signal comprising at least one combined signal of a plurality of audio channels and one or more corresponding sets of side information describing a multi-channel sound image and including channel configuration information for controlling audio source locations in a synthesis of a binaural audio signal. The at least one combined signal is processed in the processor according to said corresponding set of side information. The parametrically encoded audio signal may be received from memory means, e.g. a CD-ROM, or from a wireless network via the antenna and the transceiver Tx/Rx. The data processing device further comprises a synthesizer including e.g. a suitable filter bank and a predetermined set of head-related transfer function filters, whereby a binaural audio signal is synthesized from the at least one processed signal, wherein said channel configuration information is used for controlling audio source locations in the binaural audio signal. The binaural audio signal is then reproduced via the headphones.

Likewise, the encoding system according to the invention may as well be executed in a central processing unit CPU or in a dedicated digital signal processor DSP of the data processing device, whereby the data processing device generates a parametrically encoded audio signal comprising at least one combined signal of a plurality of audio channels and one or more corresponding sets of side information including channel configuration information for controlling audio source locations in a synthesis of a binaural audio signal.

The functionalities of the invention may be implemented in a terminal device, such as a mobile station, also as a computer program which, when executed in a central processing unit CPU or in a dedicated digital signal processor DSP, affects the terminal device to implement procedures of the invention. Functions of the computer program SW may be distributed to several separate program components communicating with one another. The computer software may be stored into any memory means, such as the hard disk of a PC or a CD-ROM disc, from where it can be loaded into the memory of mobile terminal. The computer software can also be loaded through a network, for instance using a TCP/IP protocol stack.

It is also possible to use hardware solutions or a combination of hardware and software solutions to implement the inventive means. Accordingly, the above computer program product can be at least partly implemented as a hardware solution, for example as ASIC or FPGA circuits, in a hardware module comprising connecting means for connecting the module to an electronic device, or as one or more integrated circuits IC, the hardware module or the ICs further including various means for performing said program code tasks, said means being implemented as hardware and/or software.

It is obvious that the present invention is not limited solely to the above-presented embodiments, but it can be modified within the scope of the appended claims.

The invention claimed is:

1. A method for generating a parametrically encoded audio signal, the method comprising:

inputting a multi-channel audio signal comprising a plurality of audio channels;

generating at least one combined signal of the plurality of audio channels; and generating one or more corresponding sets of side information, said sets of side information comprising parameters descriptive of an original multi-channel sound image, and said sets of side information further including channel configuration information for controlling audio source locations in a synthesis of a binaural audio signal.

2. The method according to claim 1, wherein said audio source locations are static throughout a binaural audio signal sequence, the method further comprising:

including said channel configuration information as an information field in said one or more corresponding sets of side information corresponding to said binaural audio signal sequence.

3. The method according to claim 1, wherein said audio source locations are variable, the method further comprising:

including said channel configuration information in said one or more corresponding sets of side information as a plurality of information fields reflecting variations in said audio source locations.

4. The method according to claim 1, wherein said set of side information further comprises the number and locations of loudspeakers of an original multi-channel sound image in relation to a listening position, and an employed frame length.

5. The method according to claim 1, wherein said set of side information further comprises inter-channel cues used in Binaural Cue Coding (BCC) scheme, such as Inter-channel Time Difference (ICTD), Inter-channel Level Difference (ICLD) and Inter-channel Coherence (ICC).

6. The method according to claim 1, wherein said set of side information further comprises a set of gain estimates for the channel signals of the multi-channel audio describing the original sound image.

7. The method according to claim 6, further comprising:

determining the set of the gain estimates of the original multi-channel audio as a function of time and frequency; and adjusting the gains for each loudspeaker channel such that the sum of the squares of each gain value equals to one.

8. A parametric audio encoder for generating a parametrically encoded audio signal, the encoder comprising:

means for inputting a multi-channel audio signal comprising a plurality of audio channels;

means for generating at least one combined signal of the plurality of audio channels; and means for generating one or more corresponding sets of side information, said sets of side information comprising parameters descriptive of an original multi-channel sound image, and said sets of side information further including channel configuration information for controlling audio source locations in a synthesis of a binaural audio signal.

9. The encoder according to claim 8, further comprising:

means for including said channel configuration information as an information field in said one or more corresponding sets of side information corresponding to a binaural audio signal sequence, if said audio source locations are static throughout said binaural audio signal sequence.

10. The encoder according to claim 9, further comprising:

means for including said channel configuration information in said one or more corresponding sets of side information as a plurality of information fields reflecting variations in said audio source locations, if said audio source locations are variable.

11. The encoder according to claim 8, wherein said set of side information further comprises inter-channel cues used in Binaural Cue Coding (BCC) scheme, such as Inter-channel Time Difference (ICTD), Inter-channel Level Difference (ICLD) and Inter-channel Coherence (ICC).

12. The encoder according to claim 8, wherein said set of side information further comprises a set of gain estimates for the channel signals of the multi-channel audio describing the original sound image.

13. A computer program product, stored on a non-transitory computer readable medium and executable in a data processing device, the computer program product comprising:

a computer program code section for inputting a multi-channel audio signal comprising a plurality of audio channels;

a computer program code section for generating at least one combined signal of the plurality of audio channels; and a computer program code section for generating one or more corresponding sets of side information, said sets of side information comprising parameters descriptive of an original multi-channel sound image, and said sets of side information further including channel configuration information for controlling audio source locations in a synthesis of a binaural audio signal.

14. A method for synthesizing a binaural audio signal, the method comprising:

inputting a parametrically encoded audio signal comprising at least one combined signal of a plurality of audio channels and one or more corresponding sets of side information comprising parameters descriptive of an original multi-channel sound image and including channel configuration information;

processing the at least one combined signal according to said corresponding set of side information; and synthesizing a binaural audio signal from the at least one processed signal, wherein said channel configuration information is used for controlling audio source locations in the binaural audio signal.

15. The method according to claim 14, wherein said set of side information further comprises inter-channel cues used in Binaural Cue Coding (BCC) scheme, such as Inter-channel Time Difference (ICTD), Inter-channel Level Difference (ICLD) and Inter-channel Coherence (ICC).

16. The method according to claim 15, wherein the step of processing the at least one combined signal further comprises:

synthesizing the original audio signals of the plurality of audio channels from the at least one combined signal in a Binaural Cue Coding (BCC) synthesis process, which is controlled according to said one or more corresponding sets of side information; and applying the plurality of the synthesized audio signals to a binaural downmix process.

17. The method according to claim 14, wherein said set of side information further comprises a set of gain estimates for the channel signals of the multi-channel audio describing the original sound image.

18. The method according to claim 17, wherein the step of processing the at least one combined signal further comprises:

applying a predetermined set of head-related transfer function filters to the at least one combined signal in proportion determined by said corresponding set of side information to synthesize a binaural audio signal.

19. The method according to claim 18, further comprising:

applying, from the predetermined set of head-related transfer function filters, a left-right pair of head-related transfer function filters according to said channel configuration information.

20. A parametric audio decoder, comprising:

a parametric code processor for processing a parametrically encoded audio signal comprising at least one combined signal of a plurality of audio channels and one or more corresponding sets of side information comprising parameters descriptive of an original multi-channel sound image and including channel configuration information, wherein the at least one combined signal is processed according to said corresponding set of side information; and a synthesizer for synthesizing a binaural audio signal from the at least one processed signal, wherein said channel configuration information is used for controlling audio source locations in the binaural audio signal.

21. The decoder according to claim 20, wherein said set of side information further comprises inter-channel cues used in Binaural Cue Coding (BCC) scheme, such as Inter-channel Time Difference (ICTD), Inter-channel Level Difference (ICLD) and Inter-channel Coherence (ICC).

22. The decoder according to claim 21, wherein:

said synthesizer is arranged to synthesize the original audio signals of the plurality of audio channels from the at least one combined signal in a Binaural Cue Coding (BCC) synthesis process, which is controlled according to said one or more corresponding sets of side information; and the decoder further comprises a binaural downmix unit, to which the plurality of the synthesized audio signals are applied for synthesizing a binaural audio signal according to said channel configuration information.

23. The decoder according to claim 20, wherein said set of side information further comprises a set of gain estimates for the channel signals of the multi-channel audio describing the original sound image.

24. The decoder according to claim 23, wherein:

said synthesizer is arranged to apply a predetermined set of head-related transfer function filters to the at least one combined signal in proportion determined by said corresponding set of side information to synthesize a binaural audio signal.

25. The decoder according to claim 24, wherein said synthesizer is arranged to apply, from the predetermined set of head-related transfer function filters, a left-right pair of head-related transfer function filters according to said channel configuration information.

26. A computer program product, stored on a non-transitory computer readable medium and executable in a data processing device, for processing a parametrically encoded audio signal comprising at least one combined signal of a plurality of audio channels and one or more corresponding sets of side information comprising parameters descriptive of an original multi-channel sound image and including channel configuration information, the computer program product comprising:

a computer program code section for controlling processing of the at least one combined signal according to said corresponding set of side information; and a computer program code section for synthesizing a binaural audio signal from the at least one processed signal, wherein said channel configuration information is used for controlling audio source locations in the binaural audio signal.

27. An apparatus for synthesizing a binaural audio signal, the apparatus comprising:

means for inputting a parametrically encoded audio signal comprising at least one combined signal of a plurality of audio channels and one or more corresponding sets of side information comprising parameters descriptive of an original multi-channel sound image and including channel configuration information;

means for processing the at least one combined signal according to said corresponding set of side information;

means for synthesizing a binaural audio signal from the at least one processed signal, wherein said channel configuration information is used for controlling audio source locations in the binaural audio signal; and means for supplying the binaural audio signal in audio reproduction means.

28. The apparatus according to claim 27, said apparatus being a mobile terminal, a PDA device or a personal computer.

29. The encoder according to claim 8, further comprising:

means for including said channel configuration information in said one or more corresponding sets of side information as a plurality of information fields reflecting variations in said audio source locations, if said audio source locations are variable.

* * * * *